US005542540A

United States Patent [19]

Knapp et al.

[11] Patent Number: 5,542,540

[45] Date of Patent: Aug. 6, 1996

[54] BOX LID SUPPORT

[76] Inventors: Edward R. Knapp, 1723 St. Phillip Rd., Evansville, Ind. 47712; Edward R. Knapp, II, 4524 Cynthiana Rd., Evansville, Ind. 47720; Miranda A. Knapp, 1723 St. Phillip Rd., Evansville, Ind. 47712

[21] Appl. No.: 68,432

[22] Filed: May 27, 1993

[51] Int. Cl.[6] ..... B65D 85/00

[52] U.S. Cl. ..... 206/525; 229/902; 229/906; 426/124; 426/128; 206/521

[58] Field of Search ..... 206/45.32, 521, 206/526, 525, 586, 591; 229/902, 906, 915; 426/124, 128

[56] References Cited

U.S. PATENT DOCUMENTS

| | | | |
|---|---|---|---|
| 1,939,342 | 12/1933 | Edwards | 206/525 |
| 2,020,534 | 11/1935 | Brown | 206/525 |
| 3,637,404 | 1/1972 | MacManus | 206/586 |
| 3,829,003 | 8/1974 | Dilot | 229/902 |
| 4,260,060 | 4/1981 | Fuller | 229/906 |
| 4,498,586 | 2/1985 | Vitale | 206/525 |
| 4,700,843 | 10/1987 | Cohen | 206/521 |
| 4,877,609 | 10/1989 | Beck et al. | 206/525 |
| 4,913,340 | 4/1990 | Ilitch | 229/906 |
| 5,027,050 | 12/1991 | Wall | 206/525 |
| 5,052,559 | 10/1991 | Bressi, Jr. | 206/525 |

*Primary Examiner*—David T. Fidei

*Attorney, Agent, or Firm*—Woodard, Emhardt, Naughton Moriarty & McNett

[57] ABSTRACT

A pizza box lid has a plastic support device centrally mounted to its underside. The device has a mounting portion adhesively attached to the lid, and a post portion which is originally coplanar with the mounting portion and flat against the underside of the lid. The post portion has two panels, one of the two panels being hinged to the mounting portion and the other panel being hinged to the one panel. The entire support is formed from one homogeneous piece of material which is appropriately scored to define the hingedly connected mounting and panel portions. The post portion is folded about the hinge relative to the mounting portion and away from the lid to an erect position generally perpendicular to the lid, and then one panel is folded relative to the other panel so as to prop the panels perpendicular to the lid whereby they serve as a support post to prevent the lid from sagging when the lid is closed.

11 Claims, 2 Drawing Sheets

BOX LID SUPPORT

FIELD OF THE INVENTION

The present invention is in the field of packaging devices, and more particularly, relates to a device for improving the packaging of soft products which may be damaged in containers or packages that have covers which may sag. This invention is generally applicable to shallow boxes with relatively large top areas, and more specifically to means for centrally supporting the lid to prevent collapse and resulting damage to the contents.

BACKGROUND OF THE INVENTION

In the packaging of many products including, but not limited to, food products such as pizza pies, cakes and other pies, it is important to have a container which protects the product. In many instances, the container may also need to be relatively inexpensive and disposable. When the container is relatively large and/or made of inexpensive materials, the container lid may have a tendency to sag in the middle. This creates an undesirable situation as the lid may damage or mark the product. In the pizza industry, for example, a problem occurs when a hot pizza is placed into a box for delivery to a customer, or when the customer orders a pizza for carry-out. Heat and moisture in the box and/or downward pressure exerted to the lid causes the lid of the box to become concave and sometimes come in contact with the pizza. Careless handling in the delivery process may also cause this problem. When contact is made with the hot cheese, the ingredients stick to the box and are pulled off the pizza when the box is opened. The result is an unhappy customer. The present invention pertains to an article for supporting the lid of the container so that the lid will not sag nor damage the product that is stored or carried in the container.

Prior art efforts to support the lids of containers and described in U.S. patents include the following:

Vitale, U.S. Pat. No. 4,498,586, pertains to a molded plastic device which is used in boxes or packages, such as pizza boxes, where there is a tendency for large cover portions to sag downward and damage the soft pizza or other contents. The device is placed centrally on the pie or other product to support the cover during storage and delivery. The device is unitary and, in its preferred form, has spaced vertical legs which are connected to a cover support. The lower portions of the legs have a minimal but flat cross section to minimize marking of the protected article.

Cohen, U.S. Pat. No. 4,700,843 discloses a one piece folded carton for food containment which has a detachable support element which can be folded and interlocked into a collar-like structure to be placed onto the item of food to provide central support to the lid of the carton. This invention is said to be useful in packaging pizza and the like for transportation and storage.

Beck, et al. U.S. Pat. No. 4,877,609, pertains to a combination serving utensil and pizza container support. The device has a server portion appropriate to serve a slice of pizza, and an upstanding portion which has a vertical dimension which approximates the height of the container. The latter portion serves as a lid support and is attached to another portion, which runs horizontal to the server portion, and can be used as a handle to grasp the utensil in order to serve the slice of pizza.

Brown U.S. Pat. No. 5,077,050 pertains to a pastry holding rack with upstanding prong elements, four of which project vertically from the bottom section of the box and prevent the product within from sliding horizontally and prevent the lid from coming in direct contact with the product that is held within the container.

While recognizing these prior art efforts, there remains a need for improvement. In contrast to the above container structures, it is an object of the present invention to provide a lid support that can be attached directly to the container at the container manufacturer or at any chosen site. This would simplify the process of inventory management at the food packing site by eliminating the need to locate, order and maintain a supply of containers and lid supports separately. In turn, this would reduce the amount of labor time spent in obtaining and maintaining both items, it would simplify inventory records, and it would provide a manner of ensuring that the correct number of lid supports desired per container would be consistently available. It is also an object of the present invention to provide a lid support system that can improve sanitary conditions within the package at the food packing site by eliminating the need to handle separate lid supports, which otherwise could be dropped in unsanitary areas. Another object of the present invention is to provide uniformity in the placement of the lid supports and to ensure that every package is supplied with a lid support. So it is a general object of the present invention to provide an easily manufactured, easily applied, relatively inexpensive, sanitary and convenient means to inhibit box lid sagging.

SUMMARY OF THE INVENTION

Described briefly, in a typical embodiment of the present invention, a lid support is fastened to the bottom of a box lid. The support has a planar mounting portion contacting and attached to the bottom surface of the lid, preferably centered in the box top area. The support has an integral post initially coplanar with the mounting portion but foldable downward from the lid surface, the post having a proximal end, part of which is hinged to the mounting portion and having a distal end which is located a distance less than the box wall height from the mounting portion. The post is folded along a line perpendicular to the hinge axis so that a part of the post can engage the bottom surface of the lid and serve as a buttress, holding the hinged part erect with reference to the lid. The material used in the support is resilient so that the resistance of the hinged part to folding into the erect position urges the buttress part into tight abutting engagement with the bottom surface of the lid whereby the post is maintained erect and supports the central area of the lid and prevents it from sagging.

DESCRIPTION OF THE PREFERRED EMBODIMENT

Figure 1:
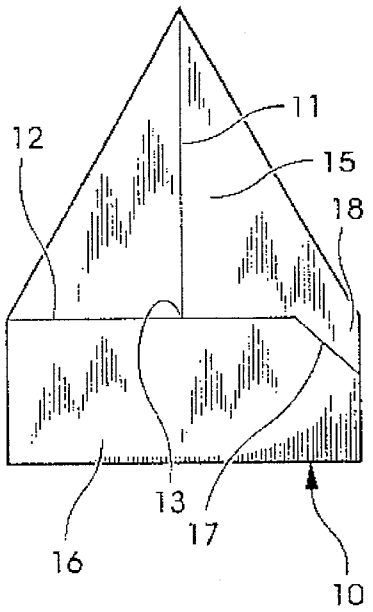
FIG. 1 is a plan view of the lid support according to the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and that modifications to the illustrated device, and further applications of the principles of the invention as illustrated therein are contemplated as would normally occur to one skilled in the art to which the invention relates.

Figure 2:
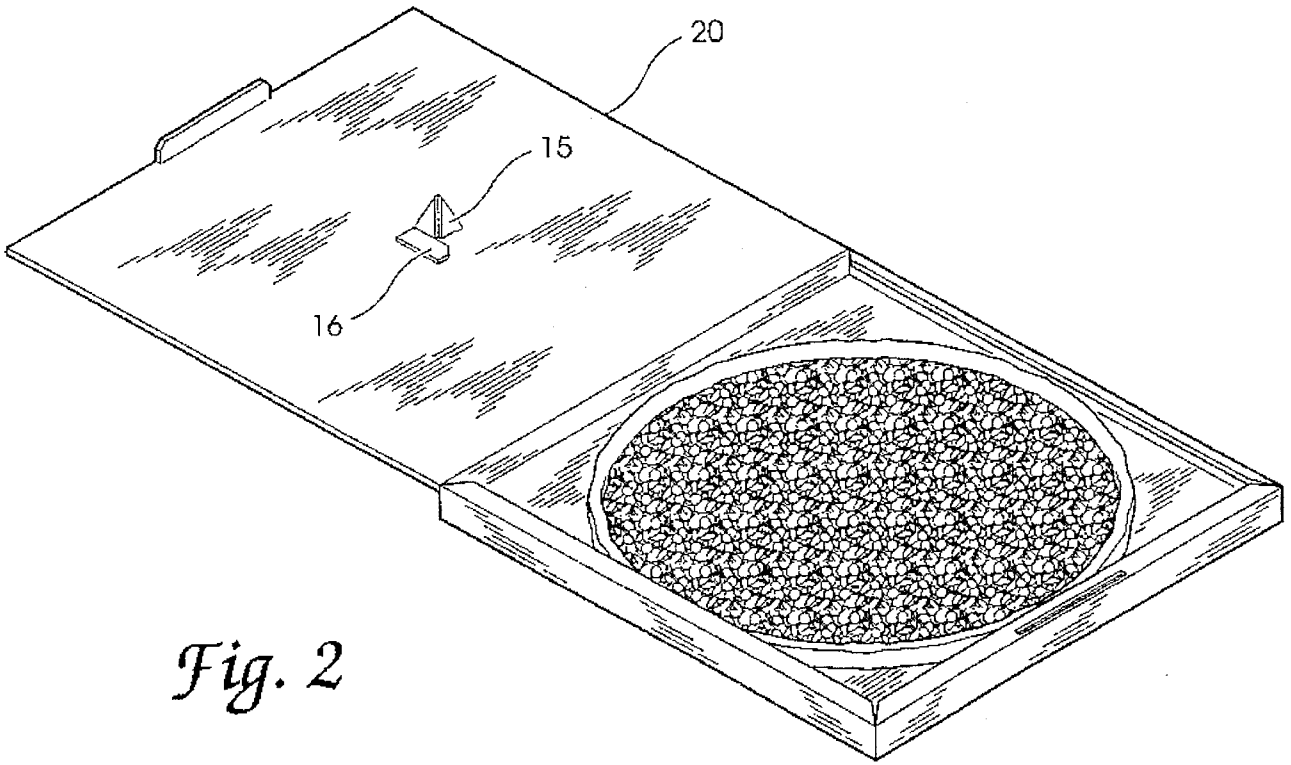
FIG. 2 is a perspective view of a box of pizza with the lid opened and the lid support of FIG. 1 erected in the center of the lid according to the preferred embodiment of the present invention.

The present invention can be implemented with a device made of plastic material such as, but not limited to, polyethylene or polypropylene that is attached to the lid of a container in order to support the lid. The lid can be hinged to the container or can be a separate item. A portion of the plastic device is attached to the lid using any of several methods including, but not limited to, an adhesive strip or glue tab that can be applied to the device or to the lid. Referring to the figures, the support device 10 is applied to a pizza box lid for preventing downward deflection of the center of the lid. The device 10 is made of polyethylene material about 0.020 inches thick with scored lines 11 and 12 which permit bending, but not breaking, of the material at those locations, thereby defining common edges (11, 12) of triangular portions or panels 24 and 15 and rectangular mounting portion 16. To the right (as shown in FIG. 1) of its intersection 13 with line 11, line 12 is scored sufficiently or cut clear through the piece to enable the triangular portion 15 to break away from the substantially rectangular portion 16 below it. Near the right hand edge of portion 16, line 12 angles down at 17, creating a triangular tab or nib 18 at the lower outer corner of portion 15. One side of rectangular portion 16 has applied thereto an adhesive substance which allows lid support device 10 to be affixed to the underside of the lid 20 of the pizza box (FIG. 2). It is also contemplated that the manufacturing process could include the adhesive being applied, not to device 10, but to the box lid 20.

Preferably, support device 10 is mounted flat to the underside surface of lid 20 when the box is manufactured, the portion 16 being glued or otherwise secured to the lid whereby it serves as a base or mounting portion of the device. The device will remain flat and coplanar with the lid until erected according to the steps shown in FIG. 3.

Figure 3:
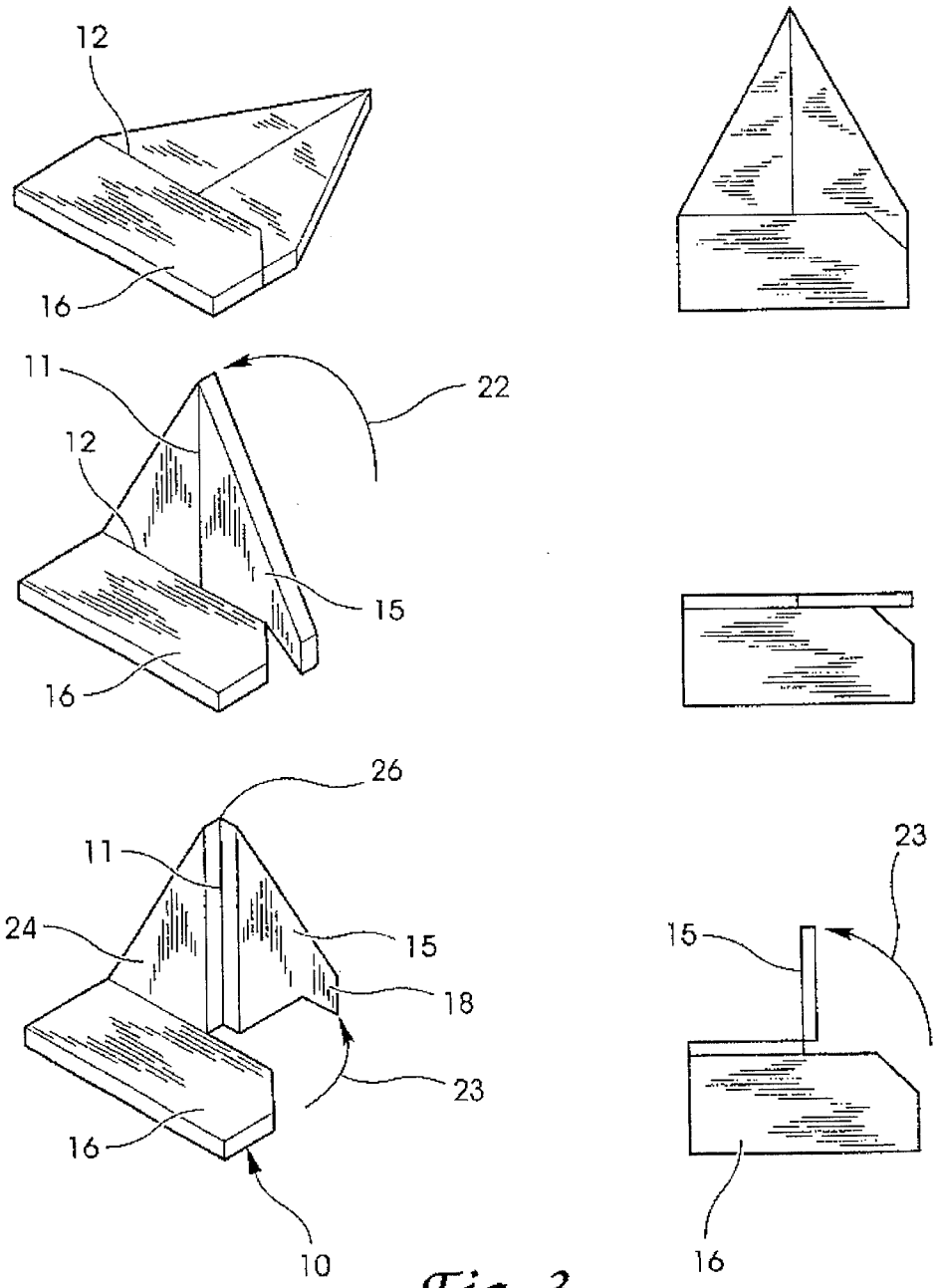
FIG. 3 is a series of views showing, from top to bottom, the sequence of steps in erecting the lid support of FIG. 1, the three views in the left column being perspective views, and the three views in the right column being plan view counterparts to the three perspective views.
Figure 4:
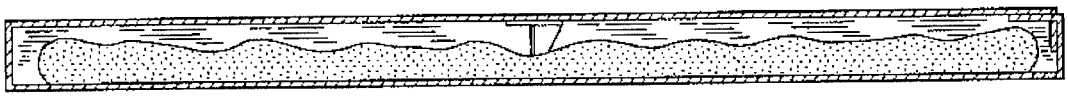
FIG. 4 is a vertical section through the pizza box containing a pizza and showing the lid support of FIG. 1 in position preventing the lid from sagging.

Referring to FIG. 3, where the pictorial views show the material thickness exaggerated, support device 10 is first folded from the flat condition (the top views in FIG. 3) upward along line 12 in the direction of arrow 22 until it is generally perpendicular to the base portion 16, (the middle views). Then the triangular portion 15 is folded along line 11 rearwardly of base 16 in the direction of arrow 23 (the lower views). With portion 15 at roughly a 90° angle to its adjacent triangular portion 24, and base portion 16 being fixed to lid 20, portion 24 is then pushed back slightly (opposite the direction of arrow 22) from its generally perpendicular orientation with respect to base 16, which action pushes nib 18 against the underside of lid 20 until nib 18 perforates the lid and locks support device into an upstanding triangular support position, as shown in the lower views of FIG. 3 and in FIG. 2. Obviously, neither triangular portion 24 or 15 need be exactly "perpendicular" with lid 20 or with each other to function properly, although such relationship is desired. When lid 20 is closed as in FIG. 4, the common apex 26 of triangles 15 and 24 engages roughly the center of the pizza and the bottom of the box to support lid 20 and keep it from deforming downwardly into contact with the pizza.

From the foregoing description, it can be recognized that the two triangular portions 24 and 15 serve as a support post, with the hinged portion 24 buttressed by the triangular portion 15, and the apex 26 of the triangles being at the distal end of the post. Also, it can be recognized that the base portion 16 need not be rectangular, and the support post portions 24 and 15 need not be triangular. In fact, base 16 and support post portions 24 and 15 can be in various configurations and include the product provider's logo. One example could be a "Pizza Hut" logo where the roof portion of the logo is at the distal end of the post and the name "Pizza Hut" is on the body of the post, and the left half of the post serves as the hinged part of the post, and the right half serves as the buttress part of the post. Also, and as preferred, if the nature of the material and the score line 12 are such that the material resiliently bends at the score line 12 as the post portion of the support device is bent upward in the direction of arrow 22 in FIG. 3, the energy stored in the hinge at the score line tends to bias the support post back toward the flat condition. Therefore, the outermost bottom edge of triangular (or other shaped) panel 15 and the nib 18 are continuously urged against the bottom of the lid, thereby preventing panel 15 from sliding back in a direction opposite arrow 23 (FIG. 3). This construction maintains the buttressing panel 15 in the right angle relationship to the hinged panel 24 of the post even if nib 18 is not pushed into the lid-piercing position. As applied to a shallow box such as the pizza box example, the depth of the support post from the underside of the lid to the distal end of the post may be about one to 1.5 inches, depending primarily upon the depth of the box for which the lid support is needed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a box lid having a lower surface, a lid support comprising:

a planar mounting portion contacting and attached to the lower surface of the lid;

a support post having a proximal end hingedly connected to the mounting portion and having a distal end which is located a distance from the mounting portion, and wherein the support post has an initial position that is coplanar with the mounting portion and has a lid supporting position that is folded downward from the lower surface of the lid into a self-sustaining configuration abutting and projecting downward from the lower surface to maintain the distal end of the support post away from the lid; and, wherein the support post includes two generally triangular portions, one triangular portion having a first base edge hingedly connected to the mounting portion and having a first side edge, the other triangular portion having a second side edge common with the first side edge, the other triangular portion being foldable at the second side edge to an acute angle with the one triangular portion, the other triangular portion having a second base edge abuttingly engageable with the lower surface of the lid to establish and maintain a locked position wherein the one triangular portion is generally perpendicular to the lower surface of the lid.

2. The lid support of claim 1 and wherein:

the mounting portion and support post are made of one homogenous piece of material.

3. The lid support of claim 2 and wherein:

the material is polyethylene and the mounting portion is adhesively attached the lower surface of the lid.

4. The lid support of claim 2 and further comprising:

pressure sensitive adhesive attaching the mounting portion to the lower surface of the lid.

5. The lid support of claim 1 and wherein:

the other triangular portion defines an apex opposite the second base edge and includes a nib extending from the second base edge away from the apex, the nib sized and positioned for penetration into the lower surface of the lid upon biasing the second base edge against the lid.

6. In a box for food having a bottom and at least four sides of a given height and a lid, the improvement comprising:

a lid support unit separate from and mounted to the lid and having a portion projecting downward therefrom into the box to limit downward movement of the lid in an area inboard of the box sides, said lid support unit including a planar mounting portion attached to the lid and including a support post having a first portion hingedly connected to the mounting portion along a first axis and having a second portion hingedly connected to the first portion along a second axis, the second portion defining an edge that is not parallel to the second axis, and wherein the support post has an initial position that is coplanar with the mounting portion and has a lid supporting position wherein the first portion is folded about 90° along the first axis and wherein the second portion is folded along the second axis to a support position.

7. In a box for food having a bottom and at least four sides of a given height and a lid, the improvement comprising:

a lid support unit separate from and mounted to the lid and having a portion projecting downward therefrom into the box to limit downward movement of the lid in an area inboard of the box sides, the support unit including a mounting portion attached to the underside of the lid and a post portion hinged to the mounting portion and projecting downward into the box and inhibiting sagging of the lid;

wherein the post portion has two intersecting panels, one of the panels having a base which is hingedly integral with the mounting portion, and the other of the panels having a lid engaging edge remote from the base and maintaining a buttressing relationship with the one panel; and, wherein the lid engaging edge has a piercing tab shaped to engage the lid and anchor the panels in a support position extending downwardly from the lid into the box.

8. The improvement of claim 7 and wherein:

the mounting portion and the panels are made of one integral homogeneous piece of material.

9. The improvement of claim 8 and wherein:

the material is a resilient thermoplastic material.

10. The improvement of claim 6 and wherein:

the support unit is mounted in the center of the lid.

11. In a box lid having a lower surface, a lid support comprising:

a planar mounting portion contacting and attached to the lower surface of the lid; and a support post having a first portion hingedly connected to the mounting portion along a first axis and having a second portion hingedly connected to the first portion along a second axis, the second portion defining an edge that is not parallel to the second axis, and wherein the support post has an initial position that is coplanar with the mounting portion and has a lid supporting position wherein the first portion is folded about 90° along the first axis and wherein the second portion is folded along the second axis, the lid supporting position further including said edge of the second portion resting unaided against the underside of the lid to hold the first portion in a position extending downwardly from the lid.

* * * * *